United States Patent [19]

Romine et al.

[11] Patent Number: 4,892,642

[45] Date of Patent: Jan. 9, 1990

[54] PROCESS FOR THE PRODUCTION OF MESOPHASE

[75] Inventors: Hugh E. Romine; Ta-Wei Fu, both of Ponca City, Okla.

[73] Assignee: Conoco Inc., Ponca City, Okla.

[21] Appl. No.: 298,536

[22] Filed: Jan. 17, 1989

Related U.S. Application Data

[63] Continuation-in-part of Ser. No. 125,968, Nov. 27, 1987, abandoned.

[51] Int. Cl.[4] ..... C10G 27/00; C10C 3/04; C10C 3/02

[52] U.S. Cl. ..... 208/39; 208/4; 208/6; 208/44; 423/447.6; 423/447.7; 423/447.8; 423/447.4

[58] Field of Search ..... 208/4, 6, 39, 44; 423/477.6, 447.7, 447.8

[56] References Cited

U.S. PATENT DOCUMENTS

| | | | |
|---|---|---|---|
| 3,116,229 | 12/1963 | Eisenhunt | 208/39 |
| 3,350,295 | 10/1967 | Hamner et al. | 208/4 |
| 3,595,946 | 7/1971 | Joo et al. | 264/29 |
| 3,856,657 | 12/1974 | Sunfield et al. | 208/6 |
| 3,909,384 | 9/1975 | Ruckel et al. | 208/4 |
| 3,974,264 | 8/1976 | McHenry | 423/447.4 |
| 3,976,729 | 8/1976 | Lewis et al. | 423/447.8 |
| 4,005,183 | 1/1977 | Singer | 208/44 |
| 4,017,327 | 4/1977 | Lewis et al. | 106/273 R |
| 4,026,788 | 5/1977 | McHenry | 208/39 |
| 4,042,486 | 8/1977 | Asano et al. | 208/44 |
| 4,066,737 | 1/1978 | Romayacek | 423/447.6 |
| 4,092,056 | 6/1978 | Haywood | 208/39 |
| 4,176,043 | 11/1979 | van Eijk | 208/6 |
| 4,209,500 | 6/1980 | Chwastiak | 423/447.6 |
| 4,277,324 | 7/1981 | Greenwood | 208/45 |
| 4,283,269 | 8/1981 | Greenwood | 208/45 |
| 4,464,248 | 8/1984 | Dickakian | 208/44 |
| 4,474,617 | 10/1984 | Uemura | 208/4 |
| 4,575,412 | 3/1986 | Yudate | 208/44 |
| 4,578,177 | 3/1986 | Yudate et al. | 208/44 |
| 4,671,864 | 6/1987 | Sauran et al. | 208/39 |

FOREIGN PATENT DOCUMENTS

| | | | |
|---|---|---|---|
| 1650901 | 4/1985 | Japan | 208/39 |
| 1223925 | 11/1968 | U.S.S.R. | 208/6 |
| 1996428 | 2/1983 | U.S.S.R. | 208/44 |
| 1260384 | 9/1986 | U.S.S.R. | 208/39 |

*Primary Examiner*—Helane Myers
*Attorney, Agent, or Firm*—C. R. Schupbach

[57] ABSTRACT

An improved process for producing an anisotropic pitch product suitable for carbon fiber manufacture. A carbonaceous feedstock substantially free of mesophase pitch is heated at elevated temperature while passing an oxidatively reactive sparging gas such as air through the feedstock. The oxidatively treated feedstock, which contains isotropic pitch, is solvent fractionated to recover a solid pitch which on fusion becomes an anisotropic pitch product having from 50 to 100 percent by volume mesophase. In one aspect of the invention the carbonaceous feedstock is oxidatively treated in a melt phase at a lower temperature and the resulting isotropic pitch is then heated at a higher temperature in a melt phase in the presence or absence of a non-oxidative sparging gas prior to solvent fractionation.

17 Claims, No Drawings

PROCESS FOR THE PRODUCTION OF MESOPHASE

RELATED APPLICATIONS

This application is a continuation-in-part of application Ser. No. 125,968, filed Nov. 27, 1987, now abandoned.

BACKGROUND OF THE INVENTION

1. Field of the Invention

The present invention pertains to an improved process for producing a carbonaceous pitch product having a mesophase content ranging from about 50 to 100 percent, which is suitable for carbon fiber manufacture. More particularly, the invention relates to a process for making mesophase containing pitch capable of producing high strength carbon fibers, by contacting a feedstock with an oxidative gas at an elevated temperature to prepare an isotropic pitch and thereafter solvent fractionating the isotropic pitch to recover a mesophase pitch product suitable for carbon fiber manufacture.

2. The Prior Art

In recent years extensive patent literature has evolved concerning the conversion of carbonaceous pitch feed material into a mesophase-containing pitch which is suitable for the manufacture of carbon fibers having desirable modulus of elasticity, tensile strength, and elongation characteristics.

U.S. Pat. No. 4,209,500 (issued to Chwastiak) is directed to the production of a high mesophase pitch that can be employed in the manufacture of carbon fibers. This patent is one of a series of patents pertaining to a process for producing mesophase pitches suitable for carbon fiber production. Each of these patents broadly involves heat treating or heat soaking the carbonaceous feed while agitating and/or passing an inert gas therethrough so as to produce a more suitable pitch product for the manufacture of carbon fibers.

As set forth in the Chwastiak patent, earlier U.S. Pat. Nos. 3,976,729 and 4,017,327 issued to Lewis et al involve agitating the carbonaceous starting material during the heat treatment. The use of an inert sparge gas during heat treatment is found in U.S. Pat. Nos. 3,974,264 and 4,026,788 issued to McHenry. Stirring or agitating the starting material while sparging with an inert gas is also disclosed in the McHenry patents.

U.S. Pat. No. 4,277,324 (Greenwood) discloses converting an isotropic pitch to an anisotropic (mesophase) pitch by solvent fractionation. Isotropic pitch is first mixed with an organic fluxing solvent. Suspended insoluble solids in the flux mixture are then removed by physical means, such as, filtration. The solids-free flux liquid is then treated with an antisolvent to precipitate a mesophase pitch. The patent further discloses heat soaking the isotropic pitch at 350° C. to 450° C. prior to solvent fractionation.

U.S. Pat. No. 4,283,269 (Greenwood) discloses a process similar to that of 4,277,324 except that the heat soaking step is carried out on the fluxed pitch.

Japanese Patent 65090/85 discloses heating a carbonaceous feed to 350°-500° C. in the presence of an oxidizing gas to prepare a mesophase pitch.

U.S. Pat. No. 4,464,248 (Dickakian) discloses a catalytic heat soak preparation of an isotropic pitch which is then solvent fractionated to produce a mesophase pitch.

U.S. Pat. No. 3,595,946 (Joo et al) and U.S. Pat. No. 4,066,737 (Romavacek) call for the use of an oxidative reactive material, such as air to produce a heavy isotropic pitch which is used to make carbon fibers.

U.S. Pat. No. 4,474,617 (Nemura et al) describes treating low mesophase content pitch with oxidizing gas at a temperature of 200° to 350° C. to produce an improved carbon fiber.

Thus, the art shows that it is known to heat soak a feed to form an isotropic pitch which yields mesophase pitch on solvent fractionation.

SUMMARY OF THE INVENTION

In accordance with the present invention, it has now been found that when a carbonaceous feedstock substantially free of mesophase pitch is contacted with an oxidative gas under suitable conditions (including an elevated temperature), a product containing isotropic pitch is formed but is not further converted to mesophase pitch. Thereafter the isotropic pitch product is solvent fractionated, and a pitch product containing 50 to 100 percent by volume mesophase, as determined by optical anisotropy, is obtained. The oxidative gas accelerates the formation of solvent fractionatable mesophase formers during the heating step. The pitch product from solvent fractionation provides fibers having high modulus and high tensile strength. In a two-step embodiment of the invention, the carbonaceous feedstock is contacted with the oxidative gas at a lower temperature level and the resulting isotropic pitch product is subjected to a heat soak at a higher temperature prior to solvent fractionation, said heat soak being carried out in a melt phase either in the presence or absence of a non-oxidative sparging gas. The use of melt phase allows thorough contacting of substantially all the pitch with the sparge gas, the melt pitch providing a substantially continuous melt phase. Thus, the present invention utilizes an oxidative acceleration of mesophase formation to yield equal amounts of mesophase pitch in less time.

DETAILED DESCRIPTION OF THE INVENTION

The carbonaceous feedstocks used in the process of the invention are heavy aromatic petroleum fractions and coal-derived heavy hydrocarbon fractions, including preferably materials designated as pitches. All of the feedstocks employed are substantially free of mesophase pitch.

The term "pitch" as used herein means petroleum pitches, natural asphalt and heavy oil obtained as a by-product in the naphtha cracking industry, pitches of high carbon content obtained from petroleum asphalt and other substances having properties of pitches produced as by-products in various industrial production processes.

The term "petroleum pitch" refers to the residuum carbonaceous material obtained from the thermal and catalytic cracking of petroleum distillates or residues.

The term "anisotropic pitch or mesophase pitch" means pitch comprising molecules having an aromatic structure which through interaction have associated together to form optically ordered liquid crystals.

The term "isotropic pitch" means pitch comprising molecules which are not aligned in optically ordered liquid crystals. Fibers produced from such pitches are inferior in quality to fibers made from mesophase pitches.

The term "resin" is used to indicate the presence of mesophase-forming materials or mesophase precursors. The presence of resins is generally directly related to the insolubles content of the pitch, i.e. pentane or toluene insoluble content is directly related to the resin content of the pitch.

Generally, feedstocks having a high degree of aromaticity are suitable for carrying out the present invention. Carbonaceous pitches having an aromatic carbon content of from about 40 percent to about 90 percent as determined by nuclear magnetic resonance spectroscopy are particularly useful in the process. So, too, are high boiling, highly aromatic streams containing such pitches or that are capable of being converted into such pitches.

On a weight basis, useful feedstocks will contain from about 88 percent to about 93 percent carbon and from about 9 percent to about 4 percent hydrogen. While elements other than carbon and hydrogen, such as sulfur and nitrogen, to mention a few, are normally present in such pitches, it is important that these other elements do not exceed about 5 percent by weight of the feedstock. Also, these useful feedstocks typically will have an average molecular weight of the order of about 200 to about 1,000.

In general, any petroleum or coal-derived heavy hydrocarbon fraction may be used as the carbonaceous feedstock in the process of this invention. Suitable feedstocks in addition to petroleum pitch include heavy aromatic petroleum streams, ethylene cracker tars, coal derivatives, petroleum thermal tars, fluid catalytic cracker residues, and aromatic distillates having a boiling range of from 650°-950° F. The use of petroleum pitch-type feed is preferred.

As stated previously the process for the preparation of isotropic pitch to be subjected to solvent fractionation may be carried out in one step, i.e. by oxidative treatment at an elevated temperature above about 320° F. Alternatively, the invention can be carried out in two steps, viz. by oxidative treatment at a lower temperature (below about 320° F.), followed by heat soaking at a higher temperature (above about 320° F.) sufficient to melt the pitch, with or without the use of a sparging non-oxidative gas, then subjected to solvent fractionation. Whichever process is employed, the preferred gas for the oxidative treatment of the carbonaceous feedstock is air or other mixtures of oxygen and nitrogen. Gases other than oxygen such as ozone, hydrogen peroxide, nitrogen dioxide, formic acid vapor and hydrogen chloride vapor, may be also used as the oxidative component in the process. These oxidative gases may be used alone or in admixture with inert (non-oxidative) components such as nitrogen, argon, xenon, helium, methane, hydrocarbon-based flue gas, steam, and mixtures thereof. In general, there can be employed any gas stream or a mixture of various gas streams with an appropriate oxidative component so that reaction with the feedstock molecules occurs to provide a carbonaceous material with increased resin content (mesophase precursors), but which is not converted to mesophase pitch.

The temperature employed in the one step oxidative process is above 320° C. and may be as high as about 500° C., wherein the pitch is in a molten state, providing a substantially continuous melt phase and allowing substantially all the pitch to be contacted by the sparge gas. Preferably the oxidative process temperature range is between about 350° C. and about 400° C. The oxidative gas rate is at least 0.1 SCFH per pound of feed, preferably from about 1.0 to 20 SCFH. Sparging with the oxidative gas is generally carried out at atmospheric or slightly elevated pressures, e.g. about 1 to 3 atmospheres, but higher or lower pressures may be used if desired. The sparging time period may vary widely depending on the feedstock, gas feed rates, and the sparging temperature. Time periods from about 0.5 to about 32 hours or more may be used. Preferably the sparging time varies from about 2 to about 20 hours. It is important that the sparging time not be excessive since an extended time of oxidation at the temperatures used will produce a mesophase pitch or coke product rather than the desired isotropic product.

The temperatures used in the oxidative step of the two step process are lower than those used in the one step process, but the pitch is still treated in a melt phase. Usually temperatures between about 200° C. and about 350° C. are employed, and preferably between about 250° C. and about 320° C. The oxidative gas rate again is at least 0.1 SCFH per pound of feed and preferably varies from about 1.0 to about 20 SCFH. Since the pitch is treated as a melt, there is substantially total control between the pitch and the gas and "channeling" is largely avoided. Pressures employed are similar to those used in the one step process. The time of sparging with the oxidative gas may be from about 2 to about 100 hours depending on the other process variables employed. More usually the sparging time is between about 4 and about 32 hours.

At the relatively low temperatures employed in the oxidative phase of the two step process the materials formed give an isotropic pitch product rather than a mesophase pitch on solvent fractionation. Thus it is necessary to further treat the pitch resulting from the low temperature oxidation of the carbonaceous feed by subjecting it to a heat soak at a temperature higher than the temperature employed in the oxidative step. The temperatures and pressures used for the heat soak are generally the same as those employed in the one step oxidative process. The soaking time will be relatively short, usually from about 0.1 to about 8 hours, depending on the other process variables employed. Here again the time of treatment is controlled to provide an isotropic pitch rather than the mesophase pitch which would result from a more extended treatment. The two-step process may be preferred to the one-step process described to enhance the total yield of mesophase pitch. The two-step method of the present invention produces a higher conversion to mesophase pitch, based on the starting feedstock.

Optionally, but not critically, the heat soak step can be carried out in melt phase in the presence of a non-oxidative sparging gas. Such a gas, when used, may be selected from the inert gases previously mentioned in the discussion of the one step oxidative process. In some instances it may be inconvenient to provide both an oxidative and a non-oxidative gas in the two-step process. In such event, the oxidative gas used in the first step may also be used as a sparging gas in the heat soak step, without detriment to the process. Of course, a different oxidative gas may also be used in each step of the two-step process, if desired.

With completion of the oxidative treatment in the one step process (or the heat soak of the two step process), the isotropic carbonaceous feed is subjected to solvent fractionation, to produce, after fusion, a pitch suitable for spinning into carbon fibers. Solvent fractionation is carried out by the following steps:

(1) Fluxing the isotropic pitch in a hot solvent.
(2) Separating flux insolubles by filtration, centrifugation or other suitable means.
(3) Diluting the flux filtrate with an anti-solvent to precipitate a mesophase forming pitch and washing and drying the precipitated pitch. After fusion, the pitch is identified as mesophase pitch.

The solvent fractionation procedure described is well known in the art and is set forth in some detail in numerous patents including U.S. Pat. No. 4,277,324, which is incorporated herein by reference. This patent sets forth the numerous solvents and anti-solvents which can be employed in solvent fractionation and the operating conditions and procedures which may be used.

In some instances the temperatures and time periods employed in the single step oxidative treatment (or in the heat soak step of the two step process) may produce a residual product which contains some mesophase pitch. If this should occur, such mesophase pitch can be removed by the treatment of the isotropic pitch with the organic fluxing solvent, along with suspended insoluble solids and materials with high melting points. The subsequent treatment with the antisolvent provides a precipitated pitch in which mesophase forming molecules capable of combining to form the optically ordered liquid crystals which characterize mesophase pitch.

The solvent fractionation treatment produces a solid pitch which on fusion becomes mesophase pitch which can be spun into continuous anisotropic carbon fibers by conventional procedures such as melt spinning, followed by the separate steps of thermosetting and carbonization. As indicated, these are known techniques and consequently they do not constitute critical features of the present invention.

The present invention will be more fully understood by reference to the following illustrative embodiments.

EXAMPLE 1

This example illustrates the one-step process of the present invention. A petroleum decant oil (900° F+ residue) was used as a feedstock for this and the other Examples. The feedstock contained 3.8 percent toluene insolubles and less than 0.1 percent THF insolubles. In this example the feed was heated for 8 hours at 385° C. A 2 percent oxygen in nitrogen gas stream was bubbled through the molten residue at 0.44 SCF per hour per pound of feed during the heating process. Oxidatively treated residual product containing isotropic pitch was obtained in 90 percent yield. The pitch also contained 31 percent toluene insolubles (TI) and 9 percent THF insolubles (THFI).

The treated pitch was solvent fractionated to produce a pitch suitable for spinning into carbon fibers. This was done by the following steps:

(1) Fluxing the heat soaked pitch in an equal weight of hot toluene.
(2) Filtering to remove flux insolubles.
(3) Diluting the flux filtrate with 8 cubic centimeters (cc) per 1 gram (g) of pitch feed with a solvent composed of 20 volume percent heptane in toluene.
(4) Cooling the solution to ambient and recovering the precipitated pitch by filtration.
(5) Washing and drying of the pitch product.

The resultant pitch obtained in 21 percent yield melted at 319° C. The melted sample was cooled and identified as 100 percent mesophase. This pitch was spun into carbon fibers which were stabilized and then carbonized to 1850° C. The fibers exhibited a tensile strength of 409 Kpsi and a tensile modulus of 31 Mpsi.

EXAMPLE 2

The example further illustrates the one-step process of the present invention. Other samples of feedstock were oxidatively treated for 2, 4 and 6 hours in three separate preparations. The process was carried out at 385° C. and 5 percent oxygen in nitrogen was bubbled through the molten reaction mixture at 0.44 SCF per hour per pound of feed. The yield and insolubles content of the oxidatively treated residues are shown in Table 1. Also shown are the yields from solvent fractionation of the oxidatively treated pitches to make mesophase pitches. The solvent fractionation conditions followed those described in Example 1. The mesophase pitches were each 100 percent mesophase. They were spun into carbon fibers which were stabilized and then carbonized. High strength high modulus fibers were produced as shown in the table.

TABLE 1

| | Example Number | | |
|---|---|---|---|
| | 2A | 2B | 2C |
| Heat Soak, hr @ 385°C. | 2 | 4 | 6 |
| Residue (containing isotropic pitch) | | | |
| Yield, % | 94 | 85 | 81 |
| Residue TI, % | 18 | 32 | 65 |
| Residue THFI, % | 5 | 11 | 18 |
| Solvent Fract. Yield, % | 21 | 24 | 25 |
| Meso. Pitch Melt Temp., °.C | 309 | 317 | 294 |
| Fiber Carb. Temp., °.C | 1850 | 1650 | 1850 |
| Carb. Fiber Tesnsile Str., Kpsi | 367 | 365 | 475 |
| Carbon Fiber Tensile Mod., Mpsi | 24 | 28 | 38 |

EXAMPLE 3

This Example shows the effect of heat soaking in the absence of a reactive oxygen-containing gas. Petroleum decant oil residue feedstock was heat soaked in the molten state at 385° C. for 8 hours while being blown with molten nitrogen at 0.44 SCF per hour per pound of feed. Heat soaked residual product containing isotropic pitch was obtained in 88 percent yield. This pitch contained 29 percent toluene insolubles and 11 percent THF insolubles.

The heat soaked pitch was solvent fractionated by the procedure outlined in Example 1. Pitch suitable for spinning into carbon filters was isolated in 24 percent yield. This pitch melted at 292° C. and was characterized as 100 percent mesophase by optical microscopy. The stabilized and carbonized (1650° C.) fibers from this pitch had a tensile strength of 439 Kpsi and a tensile modulus of 34 Mpsi.

The principal benefit of the use of an oxidative gas is more rapid formation of mesophase forming components during the oxidative treatment with no loss in fiber quality. In Example 3 (no oxygen) treatment for 8 hours at 385° F. produces heat soaked pitch yielding 24 percent mesophase.

By comparison, in Example 2, treatment at the same temperature for only 4 hours with an oxidative gas containing 5 percent oxygen produces heat soaked pitch yielding the same percent mesophase.

Comparable fibers are obtained from the pitches in both examples.

EXAMPLE 4

This comparative example and Examples 5 and 6 illustrate the necessity for high temperature thermal treatment of the heat soaked pitch produced by low temperature (below 320° F.) oxidative treatment when the objective is to produce high strength and high modulus carbon fibers. Petroleum decant oil residue was air blown at 2.0 SCF per hour per pound of feed for 16 hours at 250° C. The product containing isotropic pitch obtained in 99.8 percent yield contained 13.9 percent toluene insolubles and 1.3 percent THF insolubles.

The air blown pitch was solvent fractionated to produce a pitch suitable for spinning by the method described in Example 1. The pitch was recovered in 24.9 percent yield and melted at 297° C. The product was an isotropic pitch (0 percent mesophase) after melting. This pitch was spun into carbon fibers which were stabilized and then carbonized at 1800° C. The fibers had a tensile strength of 115 Kpsi and a tensile modulus of 5.1 Mpsi.

EXAMPLE 5

In this example the isotropic pitch feedstock of Example 4 was air blown at 300° C. for 8 hours. The air rate was 2.0 SCF per hour per pound of feed. The product containing isotropic pitch recovered in 97.8 percent yield contained 30.1 percent toluene insolubles and 7.7 percent THF insolubles.

The air blown pitch was solvent fractionated by the steps outlined in Example 1 to yield 35.4 percent of an isotropic pitch melting at 307° C. The pitch was spun into carbon fibers which were stabilized and then carbonized to 1800° C. The fibers had a tensile strength of 150 Kpsi and a tensile modulus of 6.3 Mpsi.

EXAMPLE 6

This example shows the two-step process of the present invention. The feedstock of Example 4 was air blown at 250° C. for 16 hours at an air rate of 1.0 SCF per hour per pound of feed. This was followed by 4 hours of heat soak at 385° C. while blowing the mixture with nitrogen at 2.0 SCF per hour per pound of feed. The residual product containing isotropic pitch recovered in 79.9 percent yield contained 33.4 percent toluene insolubles and 11.5 percent THF insolubles.

The heat treated pitch was solvent fractionated according to the steps outlined in Example 1. A mesophase pitch (100 percent anisotropic on fusion) was recovered in 28.4 percent yield. The mesophase melted at 317° C. The mesophase pitch was spun into carbon fibers which were stabilized and then carbonized to 1650° C. The fibers had a tensile strength of 343 Kpsi and a tensile modulus of 20 Mpsi.

A second test was carried out using the same procedure but without nitrogen blowing during the heat soak. The product containing isotropic pitch was recovered in 96.3 percent yield and contained 24 percent toluene insolubles and 11 percent THF insolubles. Upon solvent fractionation a mesophase pitch (100 percent anisotropic on fusion) was recovered in 26.1 percent yield with a melting point of 323° C.

EXAMPLE 7

A number of additional tests were carried out using the same procedures and gas rate of comparative Examples 4 and 5. The results of the oxidative treatment carried out in these tests are presented in Table 2.

TABLE 2

| Sample | Reaction Temp. °C. | Reactive Time Hr. | Gas $O_2$ Content. Vol % | Residue Insolubles. % Toluene | Residue Insolubles. % THF |
|---|---|---|---|---|---|
| 1 | Feed | None | None | 3.8 | 0.1 |
| 2 | 250 | 8 | 2 | 5.8 | 0.2 |
| 3 | 250 | 16 | 2 | 7.1 | 0.2 |
| 4 | 200 | 8 | 20* | 5.3 | 0.2 |
| 5 | 200 | 16 | 20* | 7.2 | 0.3 |
| 6 | 250 | 8 | 20* | 8.8 | 0.3 |
| 7 | 300 | 16 | 20* | 55.7 | 22.9 |

*Air used as gas.

The examples show that the oxygen treatment creates resin materials. Treatment of these increased insoluble feedstocks will allow production of mesophase materials according to the present invention.

While certain embodiments and details have been shown for the purpose of illustrating the present invention, it will be apparent to those skilled in this art that various changes and modifications may be made herein without departing from the spirit or scope of the invention.

We claim:

1. A process for producing a pitch product having a mesophase content of from 50 percent to 100 percent by volume and suitable for carbon fiber manufacture which comprises heating a carbonaceous feedstock substantially free of mesophase pitch to a melt phase at an elevated temperature while passing through the molten feedstock, a sparging gas containing an oxidatively reactive gaseous component for a sufficient period of time to produce a substantially isotropic pitch product containing mesophase precursors and thereafter solvent fractionating said pitch product to produce a solid pitch product which on fusion has said mesophase content.

2. The process of claim 1 in which the elevated temperature is above 320° C.

3. The process of claim 1 in which the elevated temperature is from about 200° C. to about 320° C. and the pitch product containing isotropic pitch is heat soaked in a melt phase in the absence of an oxidatively reactive gas at a temperature above 320° C. prior to solvent fractionation.

4. The process of claim 3 in which the heat soak is carried out in the presence of a non-oxidative sparging gas.

5. The process of claim 1 in which the elevated temperature is above 320° C. up to about 500° C.

6. The process of claim 1 in which the elevated temperature is between about 350° C. and about 400° C.

7. The process of claim 6 in which the oxidatively reactive gaseous component is selected from the group consisting of oxygen, ozone, hydrogen peroxide, nitrogen dioxide, formic acid vapor, hydrogen chloride vapor, and mixtures thereof.

8. The process of claim 7 in which the oxidatively reactive gas is used in admixture with an inert gas.

9. The process of claim 8 in which the oxidatively reactive gas is a mixture of oxygen and nitrogen.

10. The process of claim 6 wherein the pitch product is substantially 100 percent mesophase with a melting point not greater than 360° C.

11. The process of claim 4 in which the oxidatively reactive gaseous component is selected from the group consisting of oxygen, ozone, hydrogen peroxide, nitrogen dioxide, formic acid vapor, hydrogen chloride vapor, and mixtures thereof.

12. The process of claim 11 in which the oxidatively reactive gas is used in admixture with an inert gas.

13. The process of claim 12 in which the oxidatively reactive gas is a mixture of oxygen and nitrogen.

14. The process of claim 13 wherein the pitch product is substantially 100 percent mesophase with a melting point not greater than 360° C.

15. The process of claim 14 in which the time period of the oxidative treatment is from about 2 to about 100 hours and the heat soak of the oxidatively treated carbonaceous feedstock is carried out over a time period of between about 0.1 and about 8 hours.

16. The process of claim 1 in which the elevated temperature is from about 200° C. to about 320° C. and the pitch product containing isotropic pitch is heat soaked in the presence of an oxidative gas at a temperature above 320° C. prior to solvent fractionation.

17. The process of claim 16 in which the same oxidative gas is used in both steps of the process.

* * * * *